United States Patent [19]

Mullay

[11] 4,453,989

[45] Jun. 12, 1984

[54] SOLID SENSITIZERS FOR WATER-IN-OIL EMULSION EXPLOSIVES

[75] Inventor: John J. Mullay, Hazelton, Pa.

[73] Assignee: Atlas Powder Company, Dallas, Tex.

[21] Appl. No.: 365,787

[22] Filed: Apr. 5, 1982

[51] Int. Cl.[3] ..... C06B 45/02

[52] U.S. Cl. ..... 149/21; 149/41; 149/43; 149/44; 149/46; 149/60; 149/61; 149/70; 149/76; 149/77; 149/83; 149/85; 149/110; 149/114; 149/109.6; 149/2

[58] Field of Search ..... 149/2, 21, 41, 43, 44, 149/46, 60, 61, 70, 76, 77, 83, 85, 110, 114, 109.6

[56] References Cited

U.S. PATENT DOCUMENTS

| | | | |
|---|---|---|---|
| 3,674,578 | 7/1972 | Cattermole | 149/2 |
| 3,706,607 | 12/1972 | Chrisp | 149/2 |
| 3,711,345 | 1/1973 | Tomic | 149/22 |
| 3,715,247 | 2/1973 | Wade | 149/21 |
| 3,765,964 | 10/1973 | Wade | 149/2 |
| 3,790,415 | 2/1974 | Tomic | 149/2 |
| 3,899,374 | 8/1975 | Sylkhouse | 149/2 |
| 4,026,738 | 5/1977 | Richard | 149/44 |
| 4,058,420 | 11/1977 | Barnhard et al. | 149/2 |
| 4,104,092 | 8/1978 | Mullay | 149/2 |
| 4,111,727 | 9/1978 | Clay | 149/2 |
| 4,287,010 | 9/1981 | Owen | 149/2 |
| 4,294,633 | 10/1981 | Clay | 149/2 |
| 4,357,184 | 11/1982 | Binet et al. | 149/2 |

*Primary Examiner*—Stephen J. Lechert, Jr.

*Attorney, Agent, or Firm*—Richards, Harris & Medlock

[57] ABSTRACT

A water-in-oil emulsion explosive composition comprising a carbonaceous fuel, and inorganic oxidizer, an emulsifier, and a sensitizing/densifying agent of finely divided non-explosive material of high density, such as ferrophosphorus, ferrosilicon, ferromanganese, sand or alumia which is added to the oil phase. The water-in-oil composition can also contain other components, such as bulking agents, additional fuels and auxiliary sensitizers. The sensitized compositions can be detonated with a No. 6 cap in diameters as low as 2.54 centimeters at temperatures as low as 5° F. and with densities as high as 1.50 g/cc.

15 Claims, No Drawings

SOLID SENSITIZERS FOR WATER-IN-OIL EMULSION EXPLOSIVES

BACKGROUND OF THE INVENTION

This invention relates to water-in-oil emulsion type explosive compositions containing highly divided, high density, non-explosive materials which not only act as a fuel and/or densifying agent but also act as a detonation sensitizer. In particular, the invention relates to the incorporation of highly divided, high density, non-explosive materials such as ferrophosphorus, ferromanganese, ferrosilicon, sand or alumina which is added to the oil phase of a water-in-oil emulsion explosive. The term "sensitizing/densifying agent" as used herein will mean highly divided, high density, non-explosive materials which not only increase the density of water-in-oil emulsion explosives compositions but which also sensitize such compositions. In another aspect, the invention relates to the emulsion explosives having increased low temperature detonation sensitivity in small diameters at unexpectedly high densities.

The invention relates to water-in-oil emulsion explosive compositions containing an aqueous solution of inorganic oxidizer salt that is emulsified as a dispersed phase within a continuous carbonaceous fuel phase, and the sensitizing/densifying agent of the present invention. The water-in-oil emulsion explosives compositions of the present invention can also include bulking agents, additional fuels, and auxiliary sensitizers. Water-in-oil emulsion type blasting agents (i.e. explosive compositions not detonable by a No. 6 or less powerful blasting cap) were first disclosed by Bluhm in U.S. Pat. No. 3,447,978. After the disclosure of water-in-oil emulsion blasting agents, various approaches were taken to produce a emulsion explosive which was cap sensitive, i.e. detonable by a No. 6 or less powerful blasting cap. U.S. Pat. No. 3,779,522 suggests the addition of materials such as trinitrotoluene, pentaerythritol tetranitrate, and the like to conventional water-in-oil blasting agents will render them cap sensitive. However, it is well known that such materials are explosives and are more expensive than conventional ingredients that are utilized in the manufacture of water-in-oil emulsion blasting agents. Also, these compositions do not adequately perform in small diameters boreholes and are undesirable from other standpoints.

The preparation of water-in-oil emulsion explosive compositions which were rendered cap sensitive without the use of an explosive ingredients were disclosed in U.S. Pat. Nos. 3,715,247 and 3,765,964. These patents disclose the addition of a detonation sensitizer or catalyst, such as an inorganic metal compound of Atomic Number 13 or greater, and strontium compounds. While the compositions disclosed in these patents exhibited improved low temperature detonability they do not disclose a detonability of temperatures as low as −5° C.

Other attempts to produce a water-in-oil emulsion explosive with good low temperature detonability in small diameters using a fatty acid amine or ammonium salt emulsifier having a chain link ranging from 14 to 22 carbon atoms were disclosed in U.S. Pat. No. 4,141,767. However, this patent do not disclose a high density, emulsion explosive detonable in small diameters at high density.

Thus, there has been a continuing need for a small diameter, high density emulsion explosive composition which is inexpensive, detonable at low temperatures in small diameters with good detonation pressure. In one aspect, the present invention provides for a cap or cord sensitive emulsion explosive composition with improved low temperature detonability at high densities and small diameters. This is accomplished by the inclusion of a sensitizing/densifying agent of finely divided, high density, non-explosive materials, such as ferrophosphorus, ferrosilicon, ferromanganese, alumina or sand.

It is well known in the art that increasing the density of a water-in-oil emulsion explosive composition decreases its sensitivity. It is also well known in the art that the sensitivity of emulsion explosives also depends on the intimacy of the oxidizer/fuel blend. In general, the more intimate the mixture of the oxidizer and fuel phases of an emulsion the more sensitive the emulsion. Thus, those skilled in the art would expect that adding densifying agents in particulate form would desensitize rather than sensitize water-in-oil emulsions explosive compositions. Thus, it is really quite amazing that known densifying agents when sufficiently finely divided would function to increase the sensitivity of an emulsion explosive rather than to desensitize it.

SUMMARY OF THE INVENTION

According to the invention, improved water-in-oil explosive compositions are provided that can be detonated with a No. 6 cap at diameters as low as 2.54 centimeters or by detonating cord at diameters as low as 2.25 inches containing finely divided sensitizing/densifying agents. The improved cap sensitive water-in-oil emulsion of the subject invention consists essentially of from 1 to about 50% by weight of a particulate sensitizing/densifying agent; from about 10 to about 90% inorganic nitrates; from about 4 to about 20% water; from about 0.2 to about 5.0 of an emulsifier; from about 2 to about 10% carbonaceous fuels; from about 0 to 30% inorganic perchlorates; from about 0 to about 40% auxiliary sensitizers; from about 0.25 to about 10% bulking agents and from 0 to about 20% additional fuels, said percentages being based on the weight of the emulsion explosive composition.

In the preferred embodiment, the sensitizing/densifying agents are ferrophosphorus, ferrosilicon, ferromanganese, alumina and sand. Preferably, these sensitizing/densifying agents are added in particulate form sufficiently finely divided so as to pass through a 80 mesh (U.S. Standard) screen. Preferably, the sensitizing/densifying agents are added to the oil phase of the emulsion explosive compositions. Compositions formulated in accordance with the present invention are high density, cap or cord sensitive, water-in-oil emulsion explosives which can achieve a density of 1.50 grams/cc or higher and are detonable in diameters as small as 2.54 centimeters and at low temperatures (−5° C. or less).

DETAILED DESCRIPTION OF THE INVENTION

According to the present invention, an improved water-in-oil emulsion explosive composition is provided wherein particulate sensitizing/densifying agents are added to the oil phase of the water-in-oil emulsion explosive composition to achieve low temperature detonation sensitivity in small diameters and at high densities. The present invention relates to water-in-oil emulsion explosive compositions of the following general formula:

| INGREDIENTS | WEIGHT PERCENT |
|---|---|
| Inorganic nitrates | 10-90 |
| Inorganic perchlorates | 0-30 |
| Water | 4-20 |
| Emulsifier | 0.2-5.0 |
| Carbonaceous fuels | 2-10 |
| Sensitizing/densifying agents | 1-50 |
| Auxiliary sensitizers | 0-40 |
| Bulking agents | 0.25-10. |
| Additional fuels | 0-20 |

The emulsions of the present invention can be formed with compounds and by known methods consistent with obtaining a good emulsion explosive composition such as disclosed in U.S. Pat. Nos. 3,447,978; 3,715,247; 3,765,964 and 4,110,134 each of which is incorporated herein by reference. The emulsion explosive composition of the present invention exhibits low temperature sensitivity which enables the explosive compositions to be detonable at temperatures as low as 5° F. (−15° C.). The explosive compositions of the present invention also exhibit excellent detonation pressures which give the explosive compositions good rock fracturing capabilities. Therefore, explosive compositions of the type disclosed herein, exhibiting low temperature cap or cord sensitivity, as well as good rock fracturing capabilities, can be effectively used in numerous applications including use in underground mines where low temperatures are often encountered. Additionally, the explosive composition disclosed is economical to manufacture.

As discussed hereinbefore, it has been found that by incorporating particulate matter which had previously been known as a densifying and/or fuel component for water-in-oil emulsion explosives results in an improved explosive composition having unexpected characteristics. Generally, the detonation sensitivity of emulsion explosive decreases with increases in density. The compositions of the present invention unexpectedly result in improved low temperature detonation sensitivity at very high densities. It has been discovered that incorporation of particulate sensitizing/densifying agents such as ferrophosphorus, ferromanganese, ferrosilicon, sand or alumina in the oil phase of the water-in-oil emulsion results in increased density and improved low temperature detonability. Preferably, the sensitizing/densifying agents are incorporated in particulate form sufficiently finely divided to pass through a 80 mesh (U.S. Standard) screen to the oil phase of the water-in-oil emulsion explosive composition prior to emulsification with the aqueous phase. However, other densifying agents known in the art can also be utilized as a sensitizing-/densifying agent.

Densities of 1.50 grams/cc or greater can be achieved with emulsion explosive compositions of the type disclosed herein. Surprisingly, these high density water-in-oil emulsion explosive compositions are cap sensitive at low temperatures, below −5° C. in diameters as small as 2.54 centimeters.

The compositions of the present invention utilize from 1 to about 50% sensitizing/densifying agents. Preferably, the composition include sensitizing/densifying agents in the range of from about 10% to about 30% by weight of the total composition.

The carbonaceous fuel component utilizable within the scope of this invention can include most hydrocarbons, for example paraffinic, olefinic, naphthenic, aromatic, saturated or unsaturated hydrocarbons. This carbonaceous fuel component may be any of those known in the art such as waxes or oils that are immiscible with water and can be used to form the oil phase of the emulsion. The carbonaceous fuels can also include solid fuels such as coal or graphite in addition to the oil and/or water waxes.

The inorganic oxidizer generally comprises from 10 to about 90%. Preferably, the inorganic oxidizer component is a mixture of inorganic nitrates and an inorganic perchlorates. Such a mixture preferably contains more than about 6 parts of inorganic nitrates for each part of inorganic perchlorates.

The inorganic nitrate component may be any water soluble inorganic nitrate compatible with an emulsion composition such as sodium nitrate, calcium nitrate, potassium nitrate, ammonium nitrate, and other inorganic nitrates such as an alkali or alkaline earth metal nitrates. Preferably the inorganic nitrate is ammonium nitrate and is preferably used in the range of from about 45% to about 68% by weight of the emulsion explosive composition.

The inorganic perchlorate components may be any water soluble emulsion compatible perchlorate such as sodium perchlorate, calcium perchlorate, potassium perchlorate, ammonium perchlorate, lithium perchlorate, magnesium perchlorate, barium perchlorate, zine perchlorate, and the like.

Any emulsifier known in the art which the suitable for use to achieve a water-in-oil emulsion can be used. Suitable emulsifiers include derivatives from sorbitol by esterification with removal of one molecule of water such as sorbitan fatty acid esters, for example, sorbitan monolaurate, sorbitan monooleate, sorbitan monopalmitate, sorbitan monostearate, and sorbitan tristearate. Other useful emulsifiers are mono- and diglycerides of fat-forming fatty acids, as well as polyoxyethylene sorbitol esters, such as polyethylene sorbital beeswax derivative materials and polyoxyethylene(4) laurylether, polyoxyethylene(2)ether, polyoxyethylene(2)stearyl ether, polyoxyalkylene oleate, polyoxyalkylene laurate, oleyl acid phosphate, substituted oxazolines and phosphate esters, mixtures thereof and the like. In general, the emulsifier should be present in an amount ranging form about 0.2 to about 5.0% by weight of the total composition, and preferably from about 0.7 to 1.0% by weight of the total composition.

Bulking agents can be employed in the compositions of the present invention. Suitable bulking agents are those known in the art and include for example, entrained gas bubbles, phenolformaldehyde microballoons, glass microballoons, silicious glass, and perlite.

Auxiliary sensitizers can be added to the emulsions compositions of the present invention in ranges up to about 40% by weight. These auxiliary sensitizers are well known in the art and include, ethylene diamine dinitrate, monoethylamine nitrate, nitrate esters, nitroalkanes, amine nitrates and heavy metal compounds.

The compositions of the present invention may also contain up to 20% of additional fuels, suchas sulfur, aluminum, magnesium, or aluminum alloys. Additionally, water miscible fuels can also be included in the compositions of the present invention such as alcohols, amides or sugars. Optionally, other fuels such as aromatics, substituted aromatics and other substituted hydrocabons may also be utilized as an additional fuel.

The emulsions of the present invention can be formed by any method consistent with obtaining a good water-in-oil emulsion explosive composition such as disclosed in U.S. Pat. Nos. 3,447,97; 3,715,247; 3,765,964 and 4,110,134. In general, the referenced patents describe the basic procedure for formulating water-in-oil emulsions by premixing water and the inorganic oxidizers salts in a first premix, and the carbonaceous fuel (oil phase) and emulsifier to a second premix. The two premixes are heated, if necessary, and are then blended together and emulsified. Thereafter bulking agents, and other solid materials such as metallic fuels and densifying agents are added. In the preferred embodiment of the present invention the sensitizing/densifying agents are added to the premixed carbonaceous fuel phase after the emulsification of the two premixes.

EXAMPLES

The following examples are presented to exemplify and illustrate the present invention to those of ordinary skill in the art and are not intended to limit the subject invention in any manner. The water-in-oil emulsion explosive compositions were prepared by making a premix of water, the inorganic nitrates, the inorganic perchlorates and heating the mix to achieve an aqueous solution. A second premix of the carbonaceous fuel and emulsifier was heated. The first premix was then slowly added to the second premix and emulsified. The agitation was continued and the sensitizing/densifying agents, as well as the othe components such as auxiliary sensitizers and additional fuels were added. The compositions were then extruded or tamped into suitable cartridges.

Table 1 lists the compositions in terms of the concentration in percent by weight, density, diameter and temperature at the time of detonation, the priming device, and the detonation pressure.

TABLE 1

COMPOSITIONS AND PROPERTY OF EXAMPLES OF THE PRESENT INVENTION

| | I | II | III | IV | V | VI | VII | VII | IX | X | XI |
|---|---|---|---|---|---|---|---|---|---|---|---|
| Ammonium Nitrate | 58.6 | 58.6 | 60.5 | 65.3 | 58.9 | 52.2 | 45.5 | 67.4 | 57.2 | 64.0 | 57.5 |
| Sodium Nitrate | 9.7 | 9.7 | 10.0 | — | — | — | — | 3.0 | 2.6 | 2.8 | 2.5 |
| Sodium Perchlorate | — | — | — | 10.3 | 9.3 | 8.3 | 7.3 | 10.4 | 8.8 | 9.8 | 8.9 |
| Ethylenediamine Dinitrate | 9.7 | 9.7 | 10.0 | 5.0 | 4.5 | 4.0 | 3.5 | — | — | — | — |
| Water | 11.7 | 11.7 | 12.0 | 11.9 | 10.7 | 9.6 | 8.4 | 12.0 | 10.2 | 11.4 | 10.2 |
| Aristo X143 (Wax)[1] | 1.5 | 1.5 | 1.5 | 1.5 | 1.3 | 1.2 | 1.1 | 0.5 | 0.4 | 1.4 | 1.3 |
| Witco X145 (Wax)[2] | 1.5 | 1.5 | 1.5 | 1.5 | 1.3 | 1.2 | 1.1 | 0.5 | 0.4 | 1.4 | 1.3 |
| Kaydol Oil[3] | 1.0 | 1.0 | 1.0 | 1.0 | 0.9 | 0.8 | 0.7 | 3.0 | 2.6 | 1.0 | 0.9 |
| Glycomul O (Emulsifier)[4] | 1.0 | 1.0 | 1.0 | — | — | — | — | — | — | — | — |
| Span 80 (Emulsifier)[5] | — | — | — | 1.0 | 0.9 | 0.8 | 0.7 | 1.0 | 0.9 | 1.0 | 0.9 |
| B 15/250 (Glass microballoons)[6] | 1.9 | 1.9 | 2.0 | — | — | — | — | — | — | — | — |
| C 15/250 (Glass microballoons)[7] | — | — | — | 2.5 | 2.2 | 2.0 | 1.8 | 2.2 | 1.9 | 2.2 | 2.0 |
| $CuCl_2$ | 0.5 | 0.5 | 0.5 | — | — | — | — | — | — | — | — |
| Ferro Phosphorus (FeP) | — | 2.9 | — | — | 10.0 | 19.9 | 29.9 | — | 6.5 | — | — |
| Alumina | 2.9 | — | — | — | — | — | — | — | 8.5 | — | — |
| Aluminum Granules | — | — | — | — | — | — | — | — | — | 5.0 | 4.5 |
| Sand | — | — | — | — | — | — | — | — | — | — | 10.0 |
| Density (g/cc)[8] | — | — | — | 1.13 | 1.23<br>1.24 | 1.36<br>1.38 | 1.48<br>1.50 | 1.14 | 1.31 | 1.15 | 1.24 |
| Gap Sensitivity[9] (in., 1¼" diameter, 70° F.) | 3 | 3 | 1 | — | — | — | — | — | — | — | — |
| Low Temeperature Sensitivity[10] | | | | | | | | | | | |
| 1¼" dia., #6 cap, 5° F. | — | — | — | D | D | D | D | D | D | F,D | D,D |
| 2¼" dia., 40 gr. cord, 20° F. | — | — | — | F | D | D | D | — | — | — | — |
| Detonation Velocity[11] (2½", 70° F., mps) | — | — | — | 5440 | 5250 | 5250 | 4920 | — | — | — | — |
| Detonation Pressure[12] (K Bar) | — | — | — | 84 | 86 | 94 | 91 | — | — | — | — |

EXPLANATION OF THE TABLE

1. Aristo X143 Wax is the trademark for a parafin wax sold by Union Oil.
2. Witco X145 is a trademark for a microcrystalline wax sold by Witco Chemical Corp.
3. Kaydol is a trademark for a white mineral oil sold by Witco Chemical Company, Inc., New York, N.Y.
4. Glycomul O is a trademark for a sorbitan monooleate emulsifier sold by Glyco Chemical.
5. Span 80 is the trademark for a sorbitan monooleate emulsifier sold by ICI United States, Inc., Wilmington, Del.
6. B15/250 is the trademark for glass microballoons sold by the 3M Company, St. Paul, Minn.
7. C15/250 is the trademark for glass microballoons sold by the 3M Company.
8. The densities ("D") reported were measured at about 150° F.
9. Gap sensitivity is the air gap across which the explosion will propagate from one cartridge 1¼" in diameter and 8" long, and detonate a second cartridge of the same size.
10. Low temperature sensitivity is reported in terms of cartridge diameter detonated by a standard No. 6 blasting cap (equal to about 6 grains of PETN) or by a detonating cord containing 40 grains of explosive per lineal foot of cord, at the specified temperature.
11. Detonation velocities ("V") reported are the velocities in meters per second of the compositions when in a cartridge 2½ inches in diameter by 12 inches in length.
12. Detonation pressures were calculated by means of the following relation: detonation pressure $(K/Bar)=D(g/cc)\ V^2(m^2/sec^2)\times 0.0000025$.

Comparison of Example III with Examples I and II demonstrate that the use of either particulate ferrophosphorus or alumina can improve the gap sensitivity of an emulsion explosive.

Example V, VI and VII demonstrate the high densities achievable with the present invention when contrasted with Example IV the less dense emulsion which does not contain sensitizing/densifying agents. It is surprising that Examples V, VI and VII although denser than Example IV nevertheless all detonated at 5° F. with the No. 6 cap and were also detonable by a standard 40 grain detonating cord at 20° F. whereas the less dense mixture of Example IV failed. Comparison of Example IV with Examples V, VI and VII also demonstrates that the compositions of the present invention also produced significantly higher detonation pressures and thus have more useful explosive power per unit weight than the less dense explosive composition.

Example IX demonstrates that the sensitizing/densifying agents may be used in combination with one another. Example XI demonstrates that sand may be utilized as a sensitizing/densifying agent.

Examples IX, X and XI demonstrate that various sensitizing/densifying agents and combinations thereof can be utilized to achieve compositions detonable by a No. 6 blasting cap in diameters as low as 1.25 inch when at 5° F. and at densities as high as 1.32 g/cc and above.

The densities reported in Table I were measured when the emulsion compositions were at about 150° F. The densities of the various compositions are typically 0.02–0.03 g/cc greater when the emulsion cools to ambient or room temperature (68° F.–75° F.). Thus, it is apparent that water-in-oil emulsion explosive compositions with densities as high as 1.52 g/cc can be produced in accordance with the present invention.

While this invention has been described in relation to its preferred embodiments, it is to be understood that various modifications thereof will be apparent to those of ordinary skill in the art upon reading this specification and it is intended to cover all such modifications as fall within the scope of the appended claims.

What is claimed:

1. A cap sensitive water-in-oil emulsion explosive composition comprising:

(a) about 1.0 to about 90% inorganic nitrates;
(b) up to about 30% inorganic perchlorate;
(c) from about 4 to about 20% water;
(d) about 0.2 to 5.0% emulsifier;
(e) from about 2 to about 10% carbonaceous fuels;
(f) up to about 40% auxiliary sensitizers;
(g) from about 0.25 to about 10% bulking agents;
(h) up to about 20% additional fuels; and
(i) from about 1 to about 50% sensitizing/densifying agents, said percentages being based on the weight of the total composition.

2. The explosive composition of claim 1 wherein said sensitizing/densifying agents are finely divided, high density, non-explosive materials which are sufficiently finely divided to pass through an 80 mesh U.S. Standard screen.

3. The explosive composition of claim 2 wherein said sensitizing/densifying agents are selected from the group consisting of ferrophosphorus, ferrosilicon, ferromanganese, sand, alumina or combinations thereof.

4. The explosive composition of claim 3 wherein said inorganic nitrate is selected from the group consisting of alkali metal and alkaline earth metal nitrates.

5. The explosive composition of claim 4 wherein said inorganic nitrate is sodium nitrate.

6. The explosive composition of claim 3 wherein said inorganic nitrate is selected from the group consisting of ammonium nitrate, sodium nitrate, or combinations thereof.

7. The explosive composition of claim 5 wherein said inorganic perchlorate is selected from the group consisting of ammonium, alkali metal and alkaline earth metal perchlorates.

8. The explosive composition of claim 7 wherein said inorganic perchlorate is sodium perchlorate.

9. The explosive composition of claim 3 wherein said carbonaceous fuel comprises water immiscible emulsifiable material selected from the group consisting of petrolatum, microcrystalline, paraffin, mineral, animal and insect waxes, petroleum oils, and vegetable oils.

10. The explosive composition of claim 3 wherein said auxiliary fuel is particulate aluminum.

11. The explosive composition of claim 2 or 3 wherein said bulking agents are selected from the group consisting of glass microballons, phenol-formaldehyde microballoons, saran microballoons, perlite, silicious glass, and perlite and combinations thereof.

12. The explosive composition of claim 2 or 3 wherein said emulsifier is selected from the group consisting of sorbitan fatty esters, glycerides of fat-forming fatty acids, polyoxyethylene sorbitol esters, polyoxyetylene esters, polyoxyethylene oleate, polyoxyethylene alkaline chlorate, oleoacid phosphates, substituted oxylenes and phosphate esters thereof and combinations thereof.

13. The process of producing an improved water-in-oil emulsion explosive composition of the following formula:

| INGREDIENT | PERCENT BY WEIGHT OF TOTAL COMPOSITION |
|---|---|
| Inorganic nitrates | 10–90 |
| Inorganic perchlorates | 0–30 |
| Water | 4–20 |
| Emulsifier | 0.2–5.0 |
| Carbonaceous fuels | 10 |
| Sensitizing/densifying agents | 1–50 |
| Auxiliary Sensitizers | 0–40 |
| Bulking agents | 0.25–10. |
| Additional fuels | 0–20 |

the improvement comprising adding said sensitzing-/densifying agents to the carbonaceous fuel phase after emulsification of said water-in-oil emulsion explosive composition.

14. The process of claim 13 wherein said densifying agents is ferrophosphorus, ferrosilicon, ferromanganese, alumina, sand, or combination thereof.

15. The process of claim 13 or 14 wherein said sensitizing/densifying agents are sufficiently finely divided to pass through a 80 mesh U.S. Standard screen.

* * * * *

UNITED STATES PATENT AND TRADEMARK OFFICE

CERTIFICATE OF CORRECTION

PATENT NO. : 4,453,989
DATED : June 12, 1984
INVENTOR(S) : John J. Mullay

It is certified that error appears in the above—identified patent and that said Letters Patent is hereby corrected as shown below:

Column 1, line 38, change "3,779,522" to --3,770,522--.
Column 4, line 60, change "suchas" to --such as--.
Column 5, line 28, change "othe" to --other--;
line 38, Table 1, Column Heading VII, second occurrence, change "VII" to --VIII--.
Column 8, line 25, change "microballons" to --microballoons--;
lines 31-32, change "polyoxyetylene" to --polyoxyethylene--.

Column 1, line 46, change "diameters" to --diameter--;
line 50, change "ingredients" to --ingredient--;
line 63, change "do" to --does--.
Column 3, line 62, change "composition" to --compositions--.
Column 4, line 28, change "which the" to --which is--.
Column 5, line 2, change "3,447,97" to --3,447,978--.

Signed and Sealed this

Fourth Day of December 1984

[SEAL]

Attest:

GERALD J. MOSSINGHOFF

Attesting Officer

Commissioner of Patents and Trademarks